US006457707B1

(12) United States Patent
Hendrix et al.

(10) Patent No.: US 6,457,707 B1
(45) Date of Patent: Oct. 1, 2002

(54) AUTOMATIC DOCUMENT FEEDER

(75) Inventors: Steven Wayne Hendrix, Jamul; Samuel Arthur Stodder, Encinitas, both of CA (US)

(73) Assignee: Hewlett-Packard Co., Palo Alto, CA (US)

( * ) Notice: Subject to any disclaimer, the term of this patent is extended or adjusted under 35 U.S.C. 154(b) by 148 days.

(21) Appl. No.: 09/722,128

(22) Filed: Nov. 22, 2000

(51) Int. Cl.[7] ..... B65H 3/06

(52) U.S. Cl. ..... 271/117; 271/145; 271/157; 271/165

(58) Field of Search ..... 271/109, 113, 271/117, 126, 145, 157, 160, 165, 166

(56) References Cited

U.S. PATENT DOCUMENTS

| | | | | |
|---|---|---|---|---|
| 4,717,139 A | * | 1/1988 | Sootome et al. | 271/116 |
| 4,718,655 A | | 1/1988 | Okayama et al. | |
| 5,269,506 A | | 12/1993 | Olson et al. | |
| 5,277,416 A | | 1/1994 | Kim | |
| 5,391,009 A | | 2/1995 | Stodder | |
| 5,435,537 A | | 7/1995 | Gysling | |
| 5,449,161 A | | 9/1995 | Gysling | |
| 5,547,179 A | | 8/1996 | Wilcox et al. | |
| 5,882,004 A | | 3/1999 | Padget | |
| 6,009,302 A | | 12/1999 | Worley et al. | |
| 6,059,282 A | * | 5/2000 | Jang | 271/160 |
| 6,129,348 A | * | 10/2000 | Park | 271/160 |
| 6,246,466 B1 | * | 6/2001 | Hirano et al. | 271/145 X |
| 6,260,839 B1 | * | 7/2001 | Araki et al. | 271/160 X |

FOREIGN PATENT DOCUMENTS

| | | |
|---|---|---|
| EP | 0681973 B1 | 5/1998 |
| EP | 0680903 B1 | 6/1998 |
| EP | 0650842 B1 | 12/1998 |

* cited by examiner

*Primary Examiner*—David H. Bollinger

(57) ABSTRACT

An automatic document feeder for moving a stack of individual sheets from a stack loaded position to a single sheet separator in a document processing apparatus uses a gate comprised of a rotatable stack stop having a finger movable between a stack blocking position and a stack transmitting position. The stack stop is driven through a drag clutch from a single source of rotary power which also drives the conventional single sheet separator and other movable parts of the document processing apparatus. Presentation of the stack to the single sheet separator is thus automated since the operator of the document processing apparatus loads the document stack against the gate comprised of the automated stack stop to avoid operator loading of a stack directly to the nip of the single sheet separator and resultant mispicks and multipicks of sheets from the stack.

18 Claims, 6 Drawing Sheets

FIG. 4
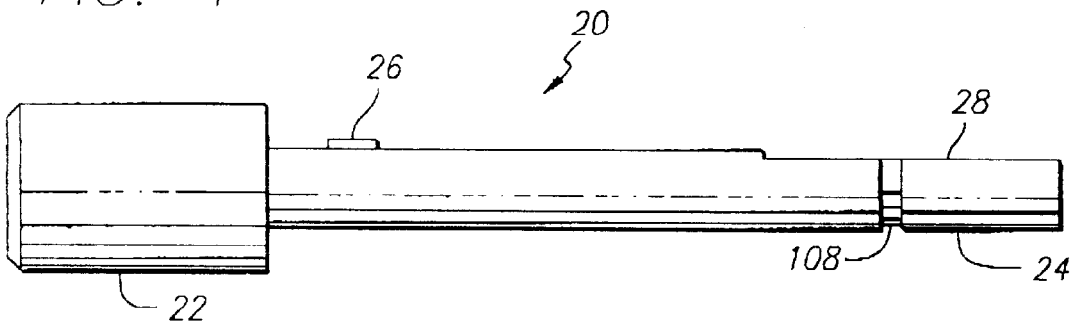
FIG. 5
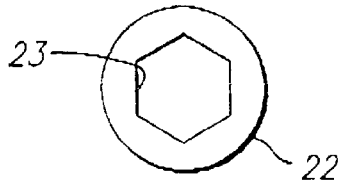
FIG. 6
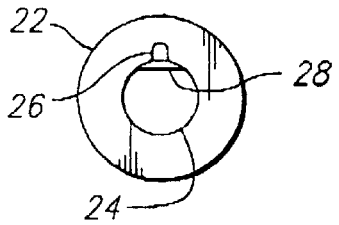
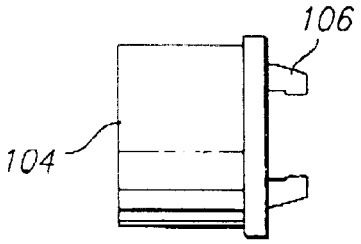
FIG. 8A
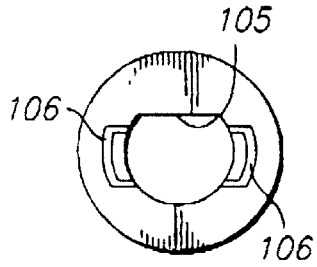
FIG. 8B
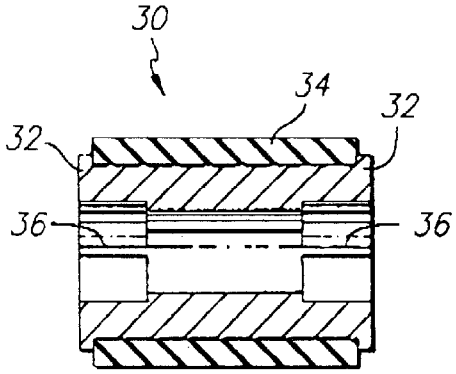
FIG. 7

AUTOMATIC DOCUMENT FEEDER

BACKGROUND OF THE INVENTION AND PRIOR ART

The present invention relates to an apparatus for feeding a stack of individual cut sheets of flat flexible media such as paper, vellum, transparencies or the like to a single sheet separator roller of a document handling device such as a scanner, facsimile machine, printer or copier and combinations of such devices. The teachings of the invention are applicable generally to any office or business machine which uses a stack of flexible media sheets which are to be fed to the machine one at a time.

Inexpensive document processing apparatus typically requires the user to place a stack of documents to be processed into the apparatus for delivery to the nip of the single sheet separator. The skill (or carelessness) of the operator determines the frequency of improper placement of the stack into the document processing apparatus. If the stack is improperly placed, as by inadvertently skewing or fanning the leading edges of the individual document sheets or by pushing the stack too far into the nip, the single sheet separator more frequently may engage and pick the wrong sheet or it may pick multiple sheets simultaneously. Accordingly, it is an object of the present invention to provide an automatic document feeder for moving a stack of individual sheets from a stack loaded position to the single sheet separator so that the operator can load the stack against an automatic document feeder rather than directly against the single sheet separator mechanism where misfeeds due to improper stack loading may occur.

SUMMARY OF THE INVENTION

The present invention provides an automatic document feeder for moving a stack of individual sheets from a stack loaded position to a nip in a single sheet separator in a document processing apparatus comprising:

a) a pre-pick roller support shaft having spaced support bearings thereon;

b) a pre-pick roller rotatably supported on said shaft, said pre-pick roller having a sheet gripping surface thereon;

c) a pressure plate resiliently biased toward said sheet gripping surface to urge a stack of sheets against said sheet gripping surface of said pre-pick roller;

d) a stack stop rotatably mounted on said shaft, said stop having at least one finger moveable between a stack blocking position in which said finger contacts said pressure plate to move said pressure plate away from contact with said pre-pick roller and a stack transmitting position in which said finger no longer contacts said pressure plate;

e) a source of rotary power connected to said shaft for rotating said pre-pick roller support shaft in a reverse reset direction and in a forward sheet delivery direction; said pre-pick roller support shaft and said pre-pick roller having mutually engageable drive stops thereon positioned such that said pre-pick roller is: (1) freely rotatable on said shaft during loading of a stack in contact with said pre-pick roller into engagement with said finger and when said shaft is driven in said forward direction to move said finger from an initial stack blocking position to a stack passing position; and (2) rotated by said rotating shaft during shaft rotation in said forward direction until a leading edge of said stack has reached said nip.

The present invention further provides a document processing apparatus comprising a document processing section, a single sheet separator having a stack receiving nip and an automatic document feeder wherein said automatic document feeder comprises:

a) a pre-pick roller support shaft having spaced shaft support bearings thereon;

b) a pre-pick roller rotatably supported on said shaft, said pre-pick roller having a sheet gripping surface thereon;

c) a pressure plate resiliently biased toward said sheet gripping surface to urge a stack of sheets against said sheet gripping surface of said pre-pick roller;

d) a stack stop rotatably mounted on said shaft, said stop having at least one finger moveable between a stack blocking position in which said finger contacts said pressure plate to move said pressure plate away from contact with said pre-pick roller and a stack transmitting position in which said finger no longer contacts said pressure plate;

e) a source of rotary power connected to said shaft for rotating said pre-pick roller shaft in a reverse reset direction and in a forward sheet delivery direction; said pre-pick roller support shaft and said pre-pick roller having mutually engageable drive stops thereon positioned such that said pre-pick roller is: (1) freely rotatable on said shaft during loading of a stack in contact with said pre-pick roller into engagement with said finger and when said shaft is driven in said forward direction to move said finger from an initial stack blocking position to a stack passing position; and (2) rotated by said rotating shaft during shaft rotation in said forward direction until a leading edge of said stack has reached said nip.

BRIEF DESCRIPTION OF THE DRAWINGS

FIG. 4 is a front view of a pre-pick roller support shaft.

FIG. 5 is a left end view of the support shaft of FIG. 4.

FIG. 6 is a right end view of the support shaft of FIG. 4.

FIG. 7 is a cross-sectional view of the pre-pick roller.

FIGS. 8*a* and 8*b* respectively comprise front and side elevation views of a pre-pick spring retainer hub.

DESCRIPTION OF THE PREFERRED EMBODIMENT

Figure 1:
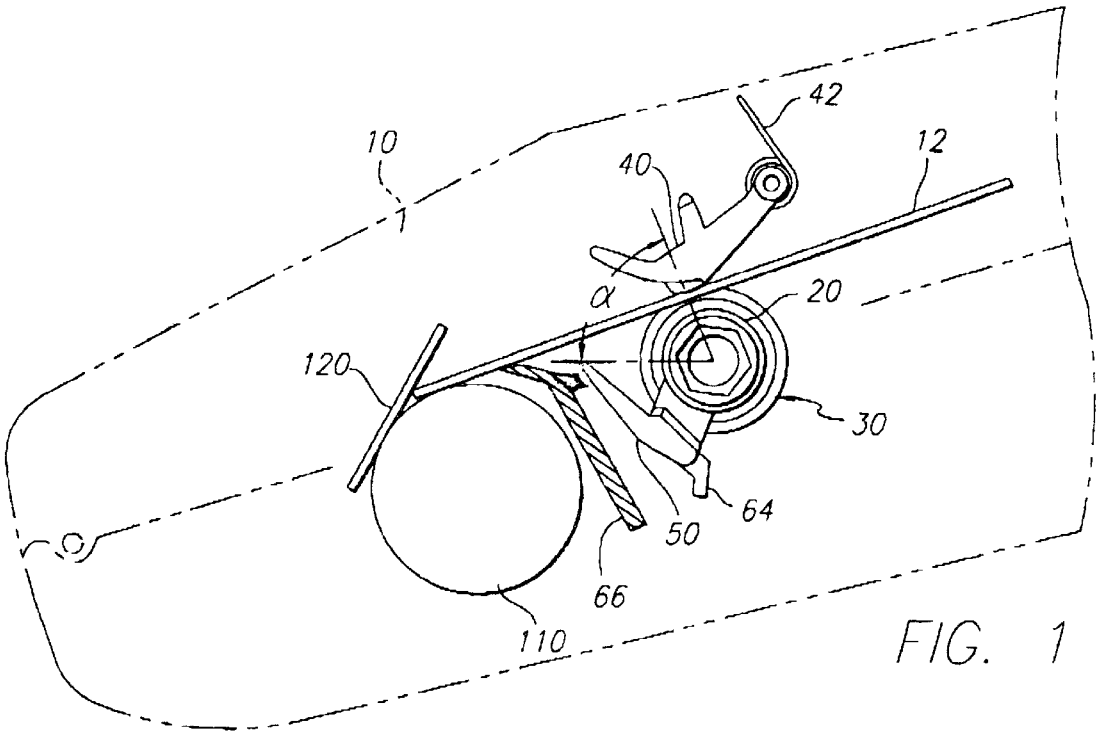
FIG. 1 is a schematic side elevation view of a first or stack receiving position of the operative parts of an automatic document feeder in a document handling device such as a facsimile machine having an outline shown in phantom.
Figure 12:
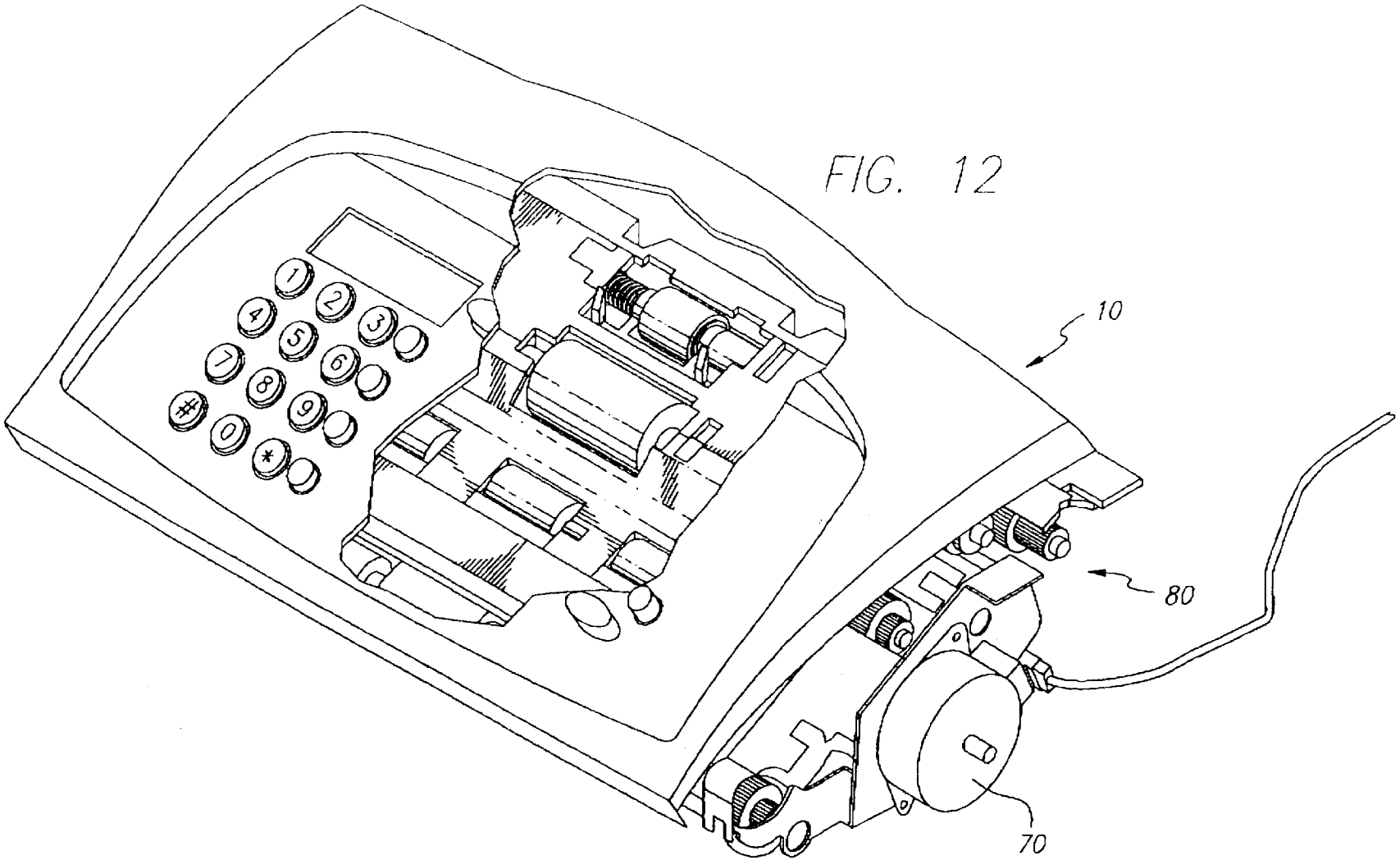
FIG. 12 is a perspective view, partly broken away, of a document processing apparatus showing a power transmission for rotating both the separator roller and the prepick roller from a single reversible motor used to power the document handling device.

As seen in the schematic side elevation view of FIG. 1 and in FIG. 12, a typical document processing apparatus, such as a scanner, facsimile machine, printer or the like, is comprised of a chassis 10 including a base and a cover which may be pivotally attached to the base to enclose the operative parts and to provide access to the paper feed path which lies above a paper support platen 12. Individual cut sheets from a stack of paper or other media to be scanned or upon which printing is to take place are delivered to a single sheet separator of conventional construction usually comprised of a separator roller 110 having a frictional surface which, in the illustrative apparatus shown, engages the lowermost sheet of paper in the stack, the stack being manually fed from the rear of the document processing apparatus. The single sheet separator also includes a resiliently biased separator pad 120 pivotally mounted on the chassis and resiliently urged against the separator roller 110 to separate a single sheet from the stack for delivery to the document processing portions of the document processing apparatus.

In the illustrated document processing apparatus comprising a combination facsimile machine/scanner, the paper delivery and support platen 12 is provided with a cutout or cutouts forming a recess or recesses 14, 16 in which the separator roller 110 and a pre-pick roller 30 and stack stop 50 pursuant to the invention are mounted. The pre-pick roller 30 and stack stop 50 as well as the separator roller 110 as shown are centrally located in the paper path although it will be appreciated that two or more axially aligned sheet separator rollers 110 preferably mounted on a common drive axle may be provided.

A transversely extending pre-pick roller support shaft 20 having spaced shaft support bearings 22, 24 thereon at or near the respective ends of the pre-pick roller support shaft 20 is provided, the bearings 22, 24 being received in suitable cradles in the recesses 14, 16 in the paper support platen 12 to support the shaft 20. As best seen in FIG. 4, the left shaft support bearing 22 is of larger diameter than the diameter of the main portion of the shaft 20 and has a non-circular opening 23 of hexagonal or other suitable cross section for slidable reception of a similarly configured male end of a powered drive axle. The shaft 20 is also provided with a radially projecting and axially extending drive stop 26 thereon and with a flat 28 near the bearing 24 and an annular groove 108 for purposes to be described.

The pre-pick roller 30 as shown in FIG. 7 preferably comprises a spool shaped hub 32 which may be round or elliptical, having end flanges for confining the sides of an elastomeric tire 34 which has an annular sheet gripping surface thereon. Preferably hub 32 is made of a polytetrafluoroethylene or similar plastic and the tire 34, which may comprise a single tire or a series of individual elastomer tires stretched over the hub 32, has a peripheral sheet gripping surface thereon for engaging and moving a stack of paper forwardly to a sheet separating nip between the single sheet separator roller 110 and separator pad 120 at selected times.

The automatic document feeder also comprises a pressure plate 40 mounted in the cover of the document processing apparatus for pivotal movement about a pivot axis under the influence of a coil spring 42 which urges the pressure plate 40 downwardly toward the annular sheet gripping surface of the pre-pick roller 30.

Figure 2:
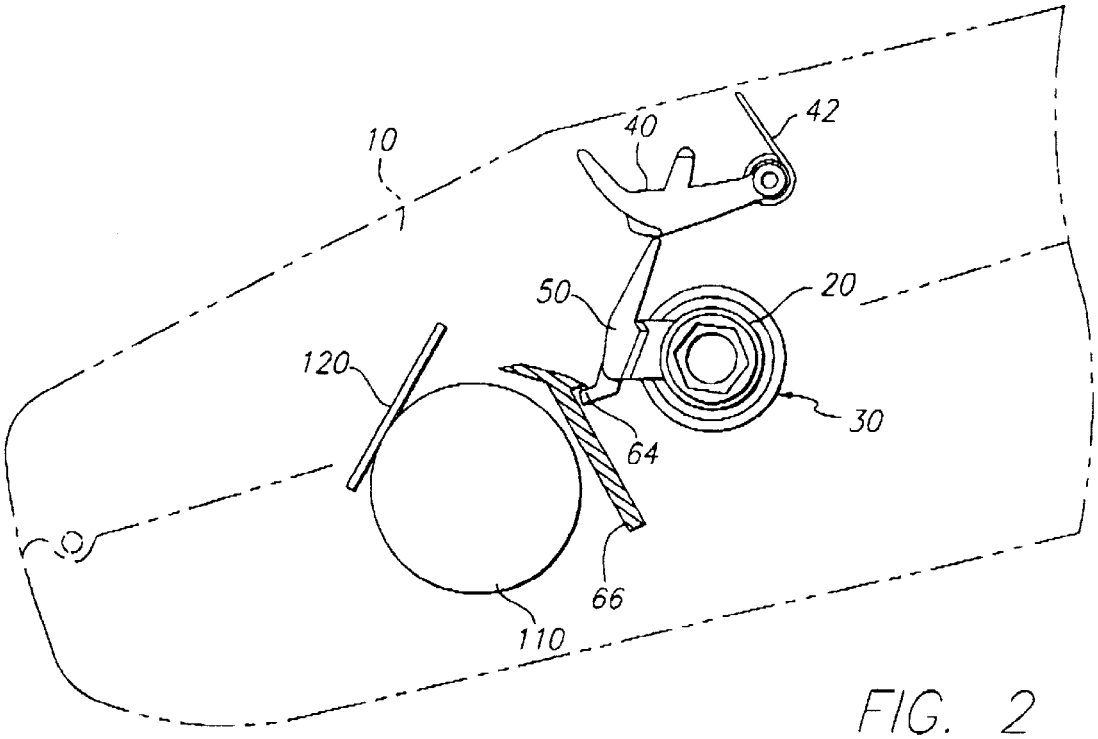
FIG. 2 is a view like FIG. 1 showing the parts in a second position in which the stack stop has been moved out of stack blocking position and the stack has been moved by a pre-pick roller into engagement with a sheet separator.
Figure 3:
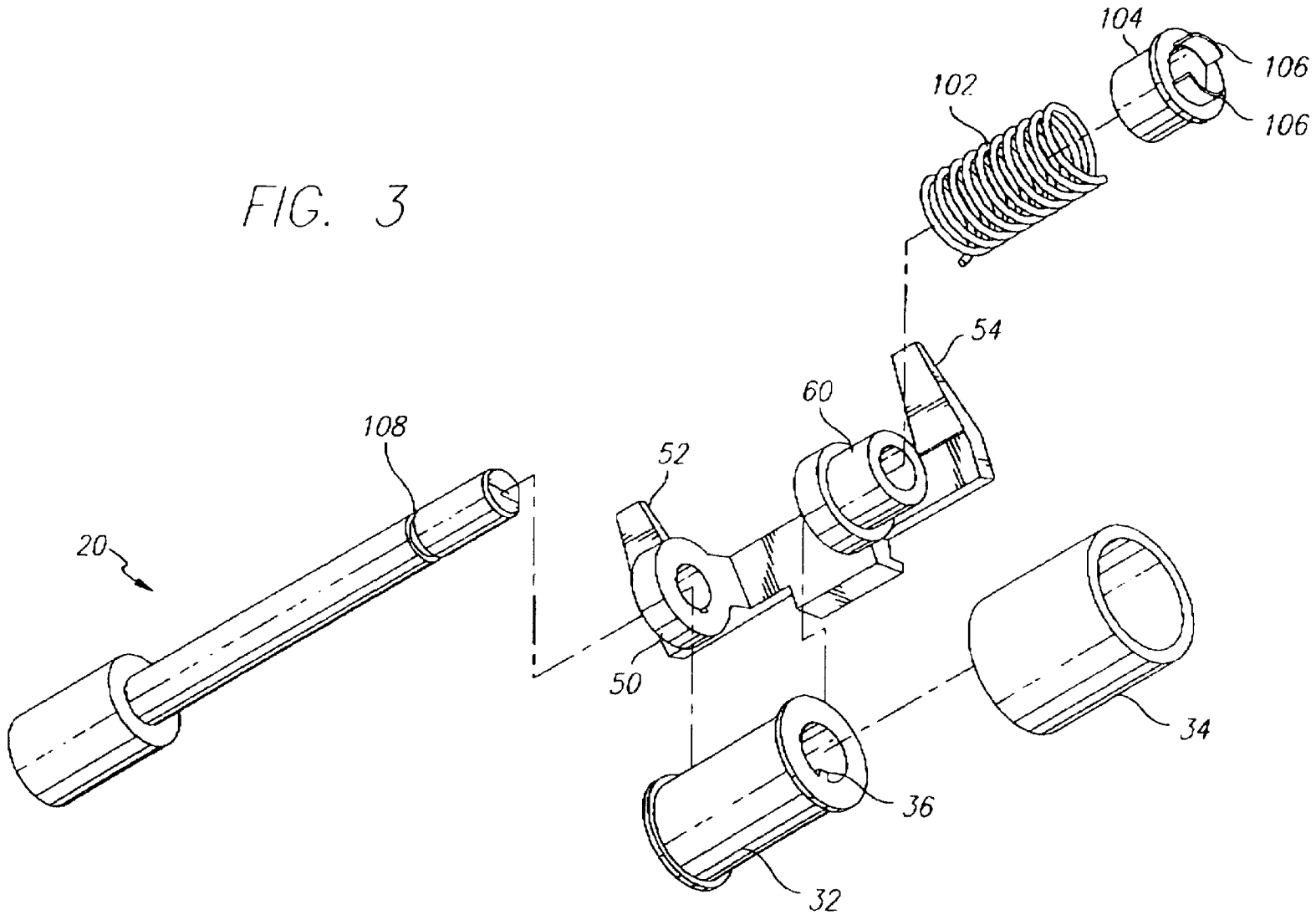
FIG. 3 is an exploded perspective view of the pre-pick roller and paper stop mechanism.

A gate or stack stop 50 configured generally as shown in the exploded perspective view of FIG. 3 is also rotatably mounted on the pre-pick roller support shaft 20. The stack stop 50 includes at least one and preferably two spaced gate fingers 52, 54 thereon which are movable through an angle $\alpha$ between (1) a paper stack blocking position shown in FIG. 2 in which the finger or fingers 52, 54 are in contact with the pressure plate 40 to hold the pressure plate away from the surface of the pre-pick roller 30 and (2) a stack transmitting position shown in FIG. 1 in which the finger or fingers 52, 54 are lowered into the recess below the paper support platen 12 out of stack blocking position.

Figure 10B:
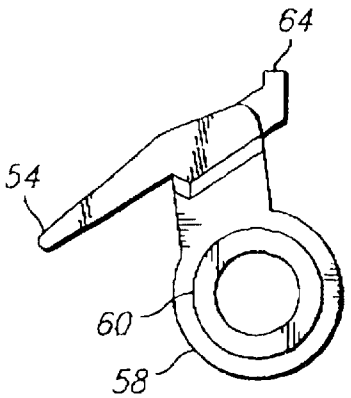
FIGS. 10*a* and 10*b* respectively comprise left side elevation and right side elevation views of the stack stop of FIG. 9.
Figure 9:
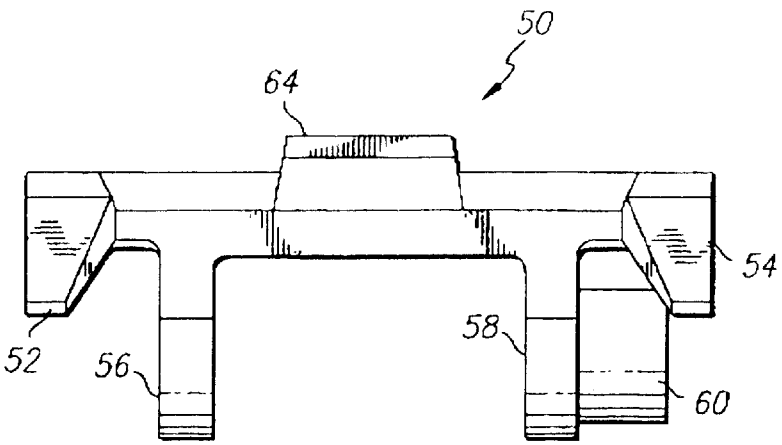
FIG. 9 is a top plan view of a stack stop.
Figure 10A:
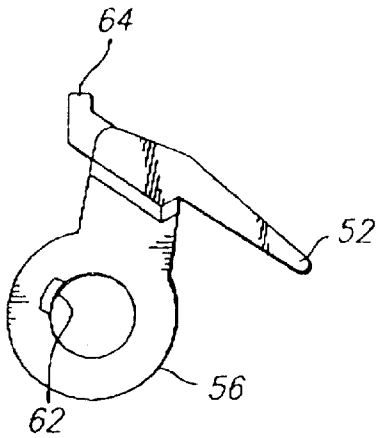
Figure 11:
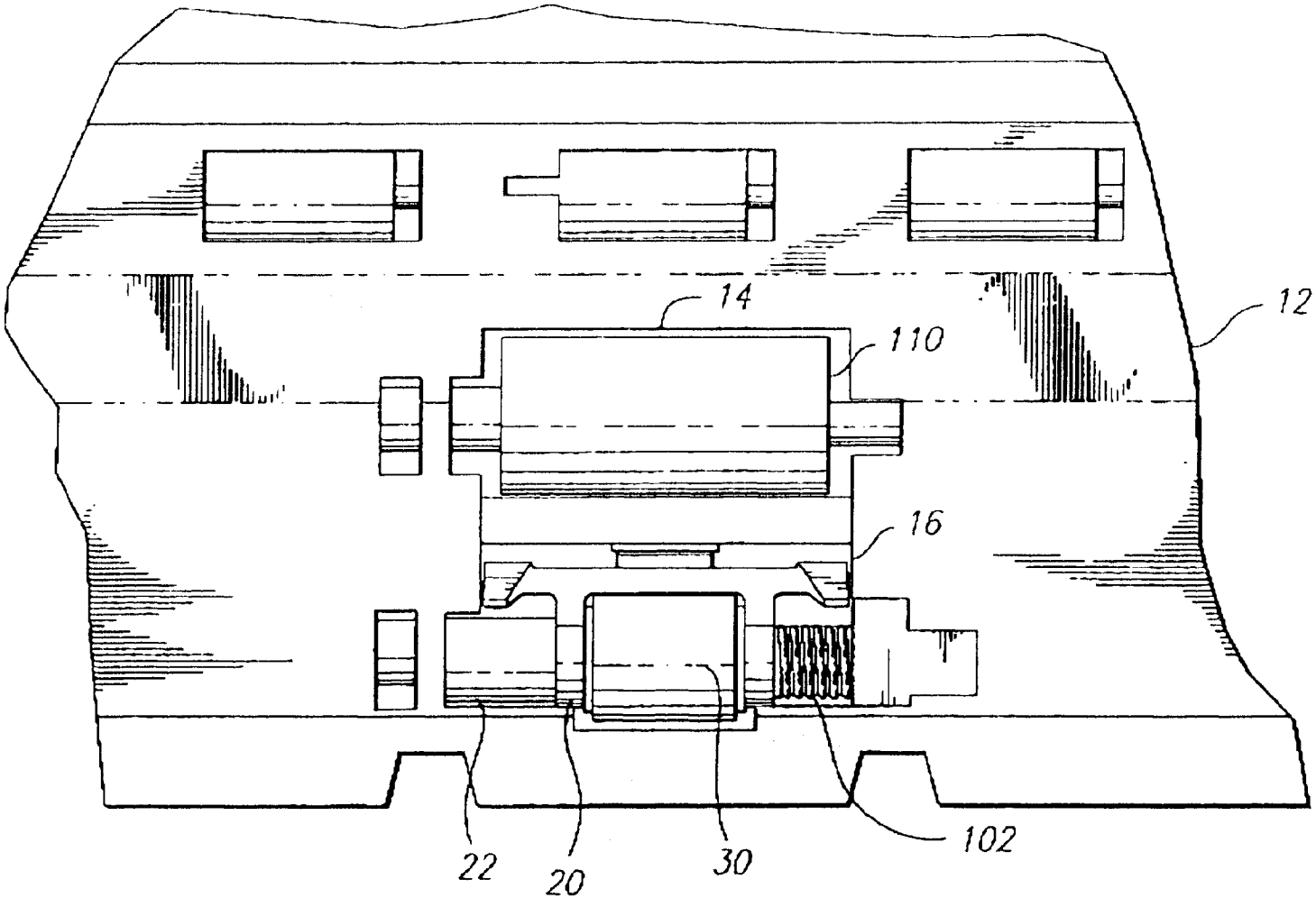
FIG. 11 is a top plan view showing the pre-pick mechanism and single sheet separator roller position on the sheet inlet platen of a document handling device.

The stock stop 50 is rotatably supported on the pre-pick roller shaft 20 by axially spaced support bearings 56, 58, one (58) of which has an axially extending spring support hub 60 integrally formed thereon. The stack stop support bearings 56, 58 are actually spaced a distance sufficient to receive the axial length of the pre-pick roller 30 therebetween. The detailed configuration of the presently preferred configuration of the stack stop 50 comprised of a single integrally formed piece is best seen in FIGS. 9 and 10; however, many other functionally equivalent single or multiple piece configurations can easily be designed by persons skilled in the art. A rotation limit stop 64 is also formed on the stack stop and is engageable with a fixed portion 66 of the chassis 10 of the document processing apparatus as the stack stop 50 is rotated on the shaft 20 to the position shown in FIG. 2. An axially extending keyway 62 (FIG. 10) in the stack stop bearing 56 is also provided to permit the stack stop 50 to be slid onto the pre-pick roller shaft 20 past the radially extending drive stop 26 on the pre-pick roller shaft 20.

A drag clutch 100 interconnects the pre-pick roller shaft 20 and the stack stop 50 in a manner to permit free rotation of the shaft 20 relative to the stack stop 50 as the shaft is driven in a forward paper delivery direction and for moving the stack stop finger or fingers 52, 54 into contact with the pressure plate 40 as the pre-pick roller shaft 20 is driven in a reverse or reset direction.

The drag clutch 100 is comprised of the axially extending spring support hub 60 on the stack stop support bearing 58 and a coil spring 102 which has a first end supported on and frictionally engaged with the spring support hub 60 and a second end which is frictionally engaged with and retained on a spring retainer hub 104 which in turn is non-rotatably mounted on the pre-pick roller shaft 20. For this purpose, the roller shaft 20 is preferably configured with the flat 28 on its upper surface as seen in FIG. 4 and the spring retainer hub 104 is provided with a through bore having a flat 105 seen in FIG. 8B to ensure that the spring retainer hub, when assembled on the end of the pre-pick roller shaft 20, does not rotate relative thereto. Shaft 20 is also preferably provided with the annular groove 108 which receives spring fingers 106 integrally formed with the spring retainer hub 104.

The pre-pick roller shaft 20, pre-pick roller 30, the stack stop 50, the drag clutch spring 102 and the drag clutch spring retainer hub 104 are assembled by positioning the pre-pick roller 30 between the support bearings 56, 58 of the stack stop 50 then sliding the stack stop 50 and pre-pick roller 30 onto the shaft 20. It will be noted that the drive roller hub 32 has an internally projecting axially extending drive stop 36 therein which is engageable with the externally projecting drive stop 26 on the pre-pick roller shaft so that the parts must be relatively rotated when being assembled to ensure that the drive stop 26 on the pre-pick roller shaft passes through the keyway 62 of the stack stop 50. The spring 102 may then be slid onto the end of the spring support hub 60 and the spring retainer hub 104 may then be slid onto the end of the pre-pick roller shaft 20 until the spring fingers 106 snap into the annular groove 108.

A power source comprised of a reversible electric stepper motor 70 and a transmission 80 comprised of a plurality of gears is used to drive both the separator roller 110 and the pre-pick roller shaft 20 as well as other operative parts of the document processing apparatus.

Operation

The apparatus is first initialized or reset by energizing the motor 70 to rotate the pre-pick roller support shaft 20 in a reverse or reset direction (clockwise as seen in FIGS. 1 and 2) which causes the drag clutch 100 to rotate the stack stop 50 to bring the finger or fingers 52, 54 upwardly (clockwise) such that the fingers 52, 54 contact the pressure plate 40 to pivotally move it against the bias of the spring 42 to the FIG. 2 position where it is seen that the limit stop 64 has engaged the stationary portion 66 of the chassis. The drag clutch coil spring 102 is tightened as this takes place. Lifting of the pressure plate 40 away from the paper gripping surface of the pre-pick roller 30 provides a space into which the paper stack can be inserted without resistance. As the user inserts a new stack of paper into the document processing apparatus, the leading edge of the paper stack engages a gate provided by the upwardly positioned stack stop fingers 52, 54 such that the stack is now stationarily positioned over the pre-pick roller 30 and under the pressure plate 40 as seen in FIG. 2. It should also be noted that, during loading of the stack into the document processing apparatus, the pre-pick roller 30 is freely rotatable when its traction surface is engaged by the stack during loading of the stack because the drive stops 26, 36 are not drivingly engaged with each other following reset and thus permit the leading edge of the stack to easily be moved into full contact with the fingers 52, 54. Unrestricted rotation of the pre-pick roller during stack insertion prevents retarding of the bottom sheet of paper in the stack by the pre-pick roller tire 34 which could cause the stack to improperly fan forwardly which may cause an out-of-order pick and resultant incorrect order of scanning or printing which is to be avoided when scanning preprinted documents or when printing on both the front and back sides of individual sheets in a stack.

After stack loading at commencement of a scanning or printing operation, the motor 70 and transmission 80 are then caused to rotate forwardly to drive the pre-pick roller shaft 20 as well as the separator roller 10 forwardly (counterclockwise in FIGS. 1 and 2). The drag clutch spring 102 creates enough torque in its free direction to move the stack stop 50 downwardly through the angle $\alpha$ until it stops and remains stationary until reset. The drag clutch 100 thus causes the stack stop 50 to rotate from the position shown in FIG. 2 downwardly to the position shown in FIG. 1 allowing the pressure plate 40 to then urge the stack against the pre-pick roller tire 34 such that the stack is now automaticly moved forwardly until the leading edge of the stack reaches the nip of the single sheet separator. The force exerted on the stack stop 50 by pressure plate 40 also assists in lowering the stack stop 50. Once the stack reaches the separator, the document sheets are individually fed to the scanning or printing section of the apparatus in conventional manner. After the last sheet is fed, the system automatically resets by driving the motor 70 and transmission 80 in the reverse direction to reverse the rotation of the separator roller 110 and pre-pick roller shaft to once again move the stack stop fingers 52, 54 from the FIG. 1 position to the FIG. 2 stack blocking position so that a new stack can be inserted into engagement with the gate fingers to ensure that the leading edge of the stack is not fanned before it reaches the nip of the single sheet separator.

Preferably, the pre-pick roller 30 is geared to rotate at a slower surface speed than the surface speed of the separator roller 110. Because of this, lag begins to develop in the pre-pick roller system as soon as the motor 70 starts driving the system. When the bottom page has been pulled past the pre-pick roller 30 by the separator roller 110, the annular surface of the pre-pick roller 30 now engages the next sheet in the stack. Because of the lag in the pre-pick roller 30, the pre-pick roller 30 does not roll at this point so the second sheet is not forced past the separator system prematurely. The lag and gear ratios are designed in such a way that for all of the paper sizes supported, the pre-pick roller 30 will never apply paper moving force to the succeeding page in the stack until the previous page has cleared the separator roller 110.

The gear ratios and other engineering details of the transmission for rotating pre-pick roller shaft and associated parts in the desired directions of rotation for the desired lengths of time are well within the skill of persons skilled in the art. Persons skilled in the art will also appreciate that various additional modifications can be made in the preferred embodiment shown and described above and that the scope of protection is limited only by the wording of the claims which follow.

What is claimed is:

1. An automatic document feeder for moving a stack of individual sheets from a stack loaded position to a nip in a single sheet separator in a document processing apparatus comprising:

a) a pre-pick roller support shaft having spaced support bearings thereon;

b) a pre-pick roller rotatably supported on said shaft, said pre-pick roller having a sheet gripping surface thereon;

c) a pressure plate resiliently biased toward said sheet gripping surface to urge a stack of sheets against said sheet gripping surface of said pre-pick roller;

d) a stack stop rotatably mounted on said shaft, said stop having at least one finger moveable between a stack blocking position in which said finger contacts said pressure plate to move said pressure plate away from contact with said pre-pick roller and a stack transmitting position in which said finger no longer contacts said pressure plate;

e) a source of rotary power connected to said shaft for rotating said pre-pick roller support shaft in a reverse reset direction and in a forward sheet delivery direction; said pre-pick roller support shaft and said pre-pick roller having mutually engageable drive stops thereon positioned such that said pre-pick roller is: (1) freely rotatable on said shaft during loading of a stack in contact with said pre-pick roller into engagement with said finger and when said shaft is driven in said forward direction to move said finger from an initial stack blocking position to a stack passing position; and (2) rotated by said rotating shaft during shaft rotation in said forward direction until a leading edge of said stack has reached said nip.

2. The automatic document feeder of claim 1, further including a drag clutch interconnecting said pre-pick roller shaft and said stack stop to permit free rotation of said shaft relative to said stack stop as said shaft is driven in said forward direction and for moving said finger into contact with said pressure plate as said shaft is driven in said reverse reset direction.

3. The automatic document feeder of claim 2, wherein said stack stop includes axially spaced bearings which receive said pre-pick roller support shaft and an axially extending spring support hub on one of said bearings and said drag clutch includes a coil spring having a first end supported on and frictionally engaged with said spring support hub.

4. The automatic document feeder of claim 3, wherein said drag clutch further comprises a spring retainer hub non-rotatably mounted on said shaft and said spring has a second end which is frictionally engaged with said spring retainer hub.

5. The automatic document feeder of claim 4, wherein said roller drive stop radially protrudes from said shaft and one of said axially spaced bearings on said stack stop includes an axially extending keyway to permit passage therethrough of said radially protruding roller drive stop on said shaft during assembly of said stack stop onto said shaft.

6. The automatic document feeder of claim 1, wherein said pressure plate is mounted for pivotal motion around an axis which is located higher than the axis of rotation of said pre-pick roller.

7. The automatic document feeder of claim 1, wherein said stack stop includes a plurality of axially spaced ones of said fingers.

8. The automatic document feeder of claim 1, wherein said pre-pick roller is mounted between axially spaced shaft support bearings on said shaft.

9. A document processing apparatus comprising a document processing section, a single sheet separator having a stack receiving nip and an automatic document feeder wherein said automatic document feeder comprises:

a) a pre-pick roller support shaft having spaced shaft support bearings thereon;

b) a pre-pick roller rotatably supported on said shaft, said pre-pick roller having a sheet gripping surface thereon;

c) a pressure plate resiliently biased toward said sheet gripping surface to urge a stack of sheets against said sheet gripping surface of said pre-pick roller;

d) a stack stop rotatably mounted on said shaft, said stop having at least one finger moveable between a stack blocking position in which said finger contacts said pressure plate to move said pressure plate away from contact with said pre-pick roller and a stack transmitting position in which said finger no longer contacts said pressure plate;

e) a source of rotary power connected to said shaft for rotating said pre-pick roller shaft in a reverse reset direction and in a forward sheet delivery direction; said pre-pick roller support shaft and said pre-pick roller having mutually engageable drive stops thereon positioned such that said pre-pick roller is: (1) freely rotatable on said shaft during loading of a stack in contact with said pre-pick roller into engagement with said finger and when said shaft is driven in said forward direction to move said finger from an initial stack blocking position to a stack passing position; and (2) rotated by said rotating shaft during shaft rotation in said forward direction until a leading edge of said stack has reached said nip.

10. The document processing apparatus of claim 9, wherein said single sheet separator comprises a driven separator roller and a separator pad resiliently biased into engagement with an arcuate surface of said separator roller.

11. The document processing apparatus of claim 10, wherein said source of rotary power includes a single motor and a transmission which is connected to said single sheet separator roller and to said pre-pick roller shaft to rotate said single sheet separator roller at a surface speed greater than the forward surface speed of said pre-pick roller.

12. The document processing apparatus of claim 11, further comprising a drag clutch interconnecting said pre-pick roller shaft and said stack stop to permit free rotation of said shaft relative to said stack stop as said shaft is driven in said forward direction and for moving said finger into contact with said pressure plate as said shaft is driven in said reverse reset direction.

13. The document processing apparatus of claim 12, wherein said stack stop includes axially spaced bearings which receive said pre-pick roller shaft and an axially extending spring support hub on one of said bearings and said drag clutch includes a coil spring having a first end supported on and frictionally engaged with said spring support hub.

14. The document processing apparatus of claim 13, wherein said drag clutch further comprises a spring retainer hub non-rotatably mounted on said shaft and said spring has a second end which is frictionally engaged with said spring retainer hub.

15. The document processing apparatus of claim 14, wherein said roller drive stop radially protrudes from said shaft and one of said axially spaced bearings on said stack stop includes an axially extending keyway to permit passage therethrough of said radially protruding roller drive stop on said shaft during assembly of said stack stop onto said shaft.

16. The document processing apparatus of claim 9, wherein said pressure plate is mounted for pivotal motion around an axis which is located higher than the axis of rotation of said pre-pick roller.

17. The document processing apparatus of claim 9, wherein said stack stop includes axially spaced ones of said stop fingers.

18. The document processing apparatus of claim 9, wherein said pre-pick roller is mounted between axially spaced shaft support bearings on said shaft.

* * * * *